US009181054B2

(12) United States Patent
Okawa

(10) Patent No.: US 9,181,054 B2
(45) Date of Patent: Nov. 10, 2015

(54) SHEET CONVEYANCE APPARATUS AND IMAGE FORMING APPARATUS

(71) Applicant: Canon Kabushiki Kaisha, Tokyo (JP)

(72) Inventor: Yuichiro Okawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/101,017

(22) Filed: Dec. 9, 2013

(65) Prior Publication Data

US 2014/0175731 A1 Jun. 26, 2014

(30) Foreign Application Priority Data

Dec. 20, 2012 (JP) ..... 2012-278520

(51) Int. Cl.

| | |
|---|---|
| ***B65H 5/26*** | (2006.01) |
| ***B65H 7/02*** | (2006.01) |
| ***B65H 5/06*** | (2006.01) |
| ***G03G 15/00*** | (2006.01) |

(52) U.S. Cl.

CPC ..... *B65H 7/02* (2013.01); *B65H 5/062* (2013.01); *B65H 5/26* (2013.01); *G03G 15/6564* (2013.01); *B65H 2402/10* (2013.01); *B65H 2513/10* (2013.01); *B65H 2513/50* (2013.01); *B65H 2701/1311* (2013.01); *B65H 2801/06* (2013.01); *G03G 2215/00945* (2013.01)

(58) Field of Classification Search

CPC ... B65H 5/26; B65H 2513/10; B65H 2402/10
USPC ..... 271/9.01, 9.13, 4.02, 4.03, 10.02, 271/10.03, 10.09, 10.11, 265.02, 270, 9.11
See application file for complete search history.

(56) References Cited

U.S. PATENT DOCUMENTS

| | | | | |
|---|---|---|---|---|
| 5,393,043 | A * | 2/1995 | Nitta | 271/9.06 |
| 7,556,254 | B2 * | 7/2009 | Wada | 271/9.02 |
| 7,810,811 | B2 * | 10/2010 | Suzuki et al. | 271/270 |
| 8,498,007 | B2 * | 7/2013 | Ito | 358/1.15 |
| 8,626,050 | B2 * | 1/2014 | Takahashi | 399/388 |
| 2003/0057639 | A1 * | 3/2003 | Chapman et al. | 271/270 |
| 2012/0104679 | A1 * | 5/2012 | Blair et al. | 271/9.13 |

FOREIGN PATENT DOCUMENTS

JP 2007-261705 A 10/2007

* cited by examiner

*Primary Examiner* — Michael McCullough
(74) *Attorney, Agent, or Firm* — Canon U.S.A., Inc. IP Division

(57) ABSTRACT

A sheet conveyance apparatus conveys a sheet without imposing a load on a drive unit due to the bend of the sheet when the sheet is conveyed from one unit to the other, and when the sheet is conveyed by a second conveyance unit and a first conveyance unit, a first control unit controls a first drive motor and a second control unit controls a second drive motor to make a sheet conveyance speed of the first conveyance unit equal to or higher than that of the second conveyance unit.

24 Claims, 5 Drawing Sheets

SHEET CONVEYANCE APPARATUS AND IMAGE FORMING APPARATUS

BACKGROUND OF THE INVENTION

1. Field of the Invention

The present invention relates to a sheet conveyance apparatus and an image forming apparatus.

2. Description of the Related Art

Heretofore, there has been known a feeding option which can be attached to an image forming apparatus main body in Japanese Patent Application Laid-Open No. 2007-261705. Unlike anything that is originally mounted on an image forming apparatus when the apparatus is manufactured, the feeding option is the one that a user optionally adds to an image forming apparatus being a finished product to add functions and enhance performances thereof. The feeding option is sold separately from the image forming apparatus being the finished product, and used after a purchaser combining the feeding option with the image forming apparatus being the finished product. Some of the feeding options can store a large amount of sheets and sheets different in sizes.

The image forming apparatus on which the feeding option is mounted can form an image not only on a sheet fed from a sheet feeding unit of the image forming apparatus main body but also on a sheet fed from the feeding option to the image forming apparatus main body.

When the feeding option feeds a sheet to the image forming apparatus main body, dispersion sometimes occurs among timings of when a sheet conveyed from the feeding option reaches the image forming apparatus main body. A reason the dispersion occurs seems to be due to a state where the sheets are set on the feeding option, the friction resistance between the sheets, slippage between a roller and the sheet, and the dispersion of start of drive operation.

If a sheet conveyed from the feeding option reaches the image forming apparatus main body earlier than a predetermined timing, the image forming apparatus main body decreases the sheet conveyance speed to cause the timing of the sheet to agree with a timing of a transfer unit. Then, the sheet conveyance speed in the image forming apparatus main body becomes lower than that in the feeding option to deform the sheet conveyed between the image forming apparatus main body and the feeding option in the direction in which the sheet is bent.

When the sheet is deformed in the direction in which the sheet is bent, the sheet applies a pushing force against a conveyance roller in the feeding option in the direction opposite to the conveyance direction to increase a load applied to a drive unit for driving the conveyance roller. This increases a torque required for the drive unit for driving the conveyance roller in the feeding option, which may increase the size and cost of the apparatus.

SUMMARY OF THE INVENTION

The present invention is directed to a sheet conveyance apparatus capable of conveying a sheet without imposing a load on a drive unit due to the bend of the sheet when the sheet is conveyed from one unit to the other.

According to an aspect of the present invention, in a sheet conveyance apparatus with a first unit and a second unit attachable to the first unit, the first unit includes a first conveyance unit configured to convey a sheet, a first drive unit configured to drive the first conveyance unit, a first detection unit provided in the vicinity of the first conveyance unit and configured to detect the sheet, and a first control unit configured to control the drive of the first drive unit so that a sheet conveyance speed of the first conveyance unit changes based on a result of detection by the first detection unit, and the second unit includes a second conveyance unit provided upstream of the first conveyance unit and configured to convey the sheet, a second drive unit configured to drive the second conveyance unit, a second detection unit provided in the vicinity of the second conveyance unit and configured to detect the sheet, and a second control unit configured to control the drive of the second drive unit so that a sheet conveyance speed of the second conveyance unit changes based on a result of detection by the second detection unit. When the sheet is conveyed by the second and first conveyance units, the first control unit controls the first drive unit and the second control unit controls the second drive unit so that the sheet conveyance speed of the first conveyance unit becomes equal to or higher than that of the second conveyance unit.

Further features of the present invention will become apparent from the following description of exemplary embodiments with reference to the attached drawings.

DESCRIPTION OF THE EMBODIMENTS

Figure 1:
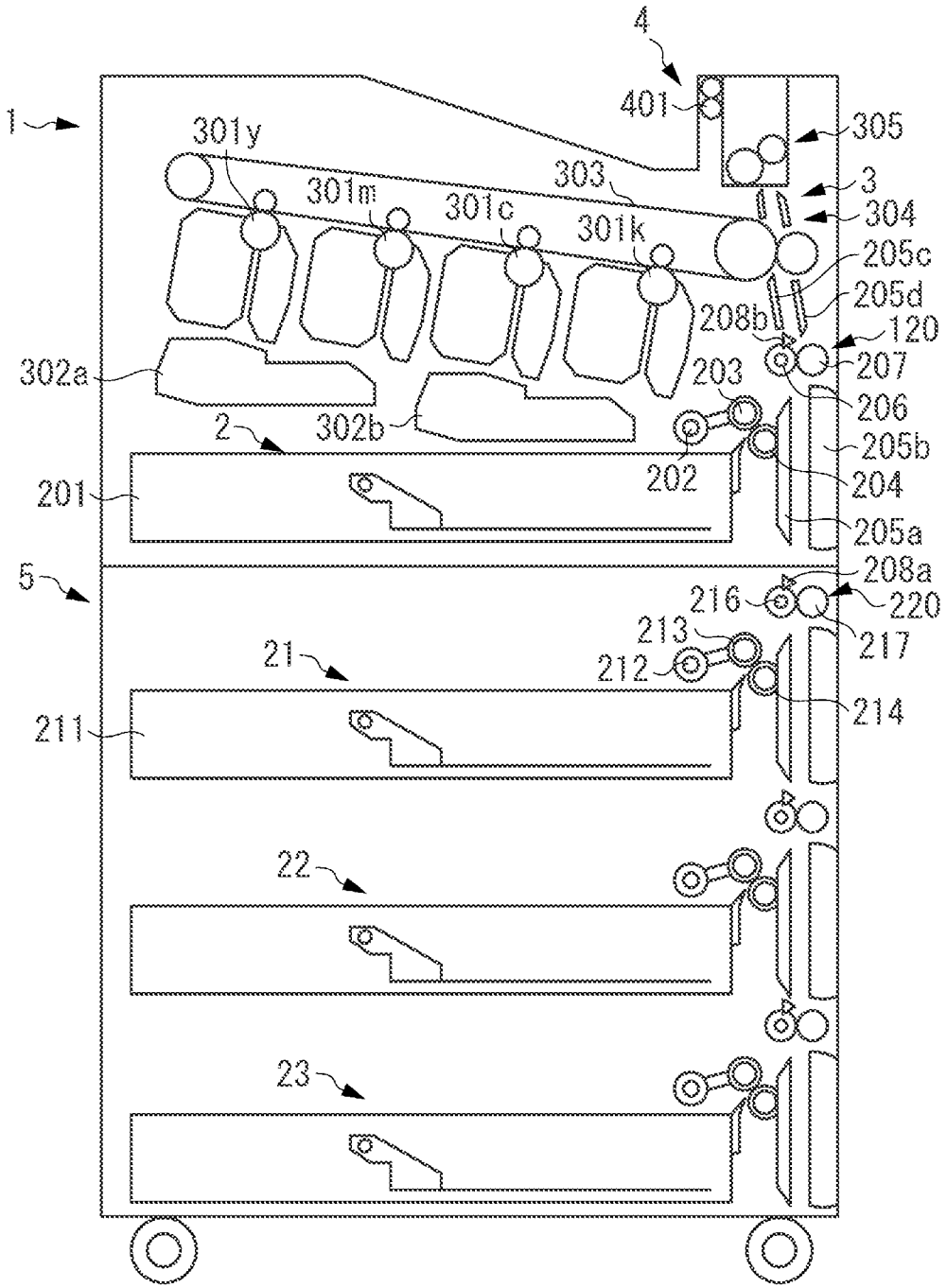
FIG. 1 is a front view of an image forming apparatus to which a first exemplary embodiment is applied.

Various exemplary embodiments, features, and aspects of the invention will be described in detail below with reference to the drawings. FIG. 1 is a front view of an image forming apparatus 100 to which a first exemplary embodiment is applied. The image forming apparatus 100 includes an image forming apparatus main body 1 acting as a first unit and a feeding unit 5 acting as a second unit which can be attached to the image forming apparatus main body 1.

Figure 2:
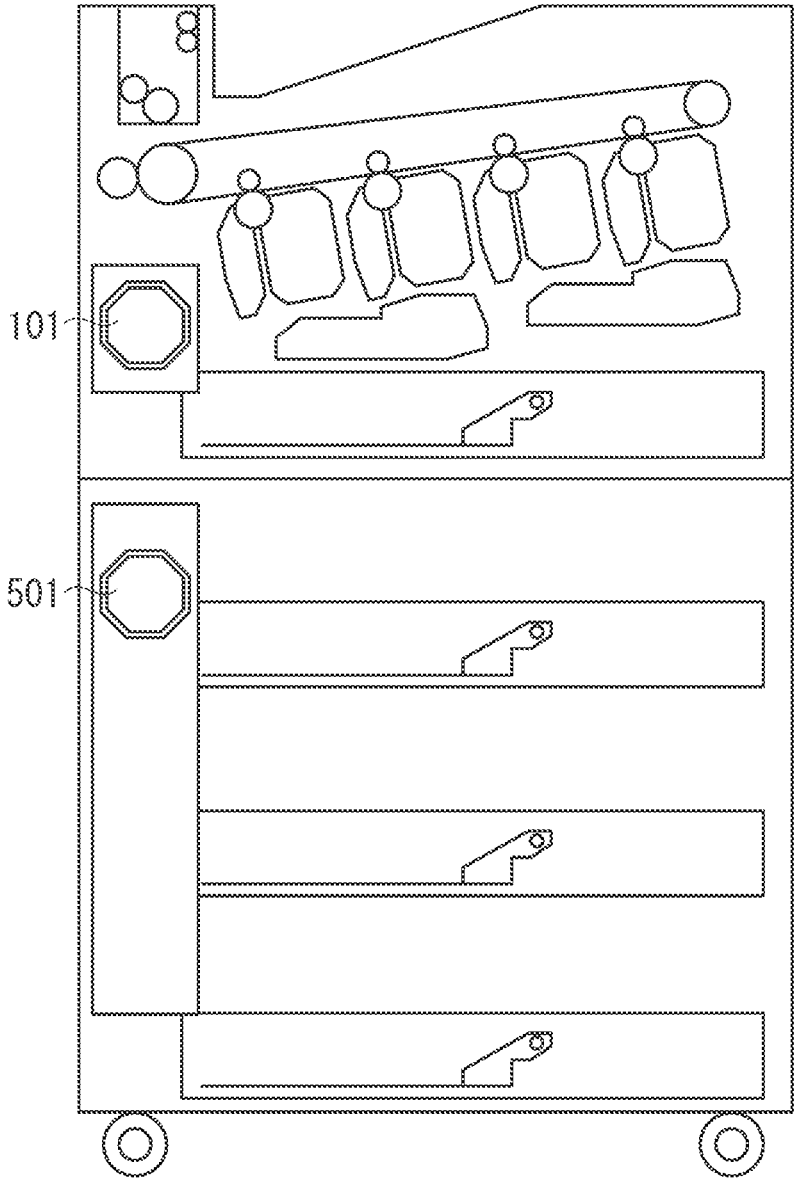
FIG. 2 is a rear view of the image forming apparatus to which the first exemplary embodiment is applied.
Figure 3:
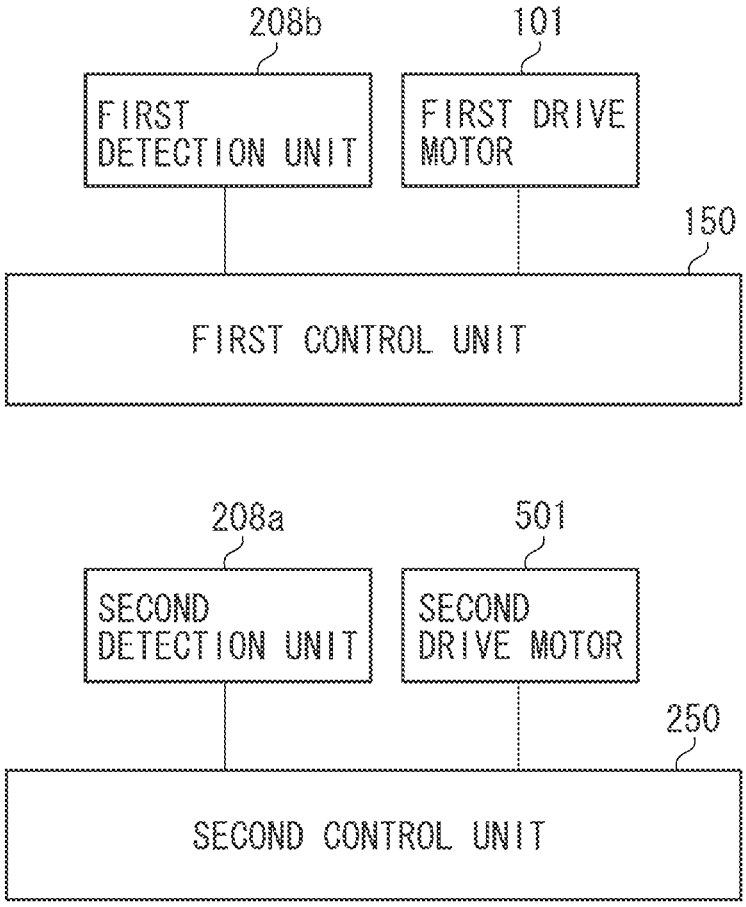
FIG. 3 is a block diagram of the first exemplary embodiment.
Figure 4:
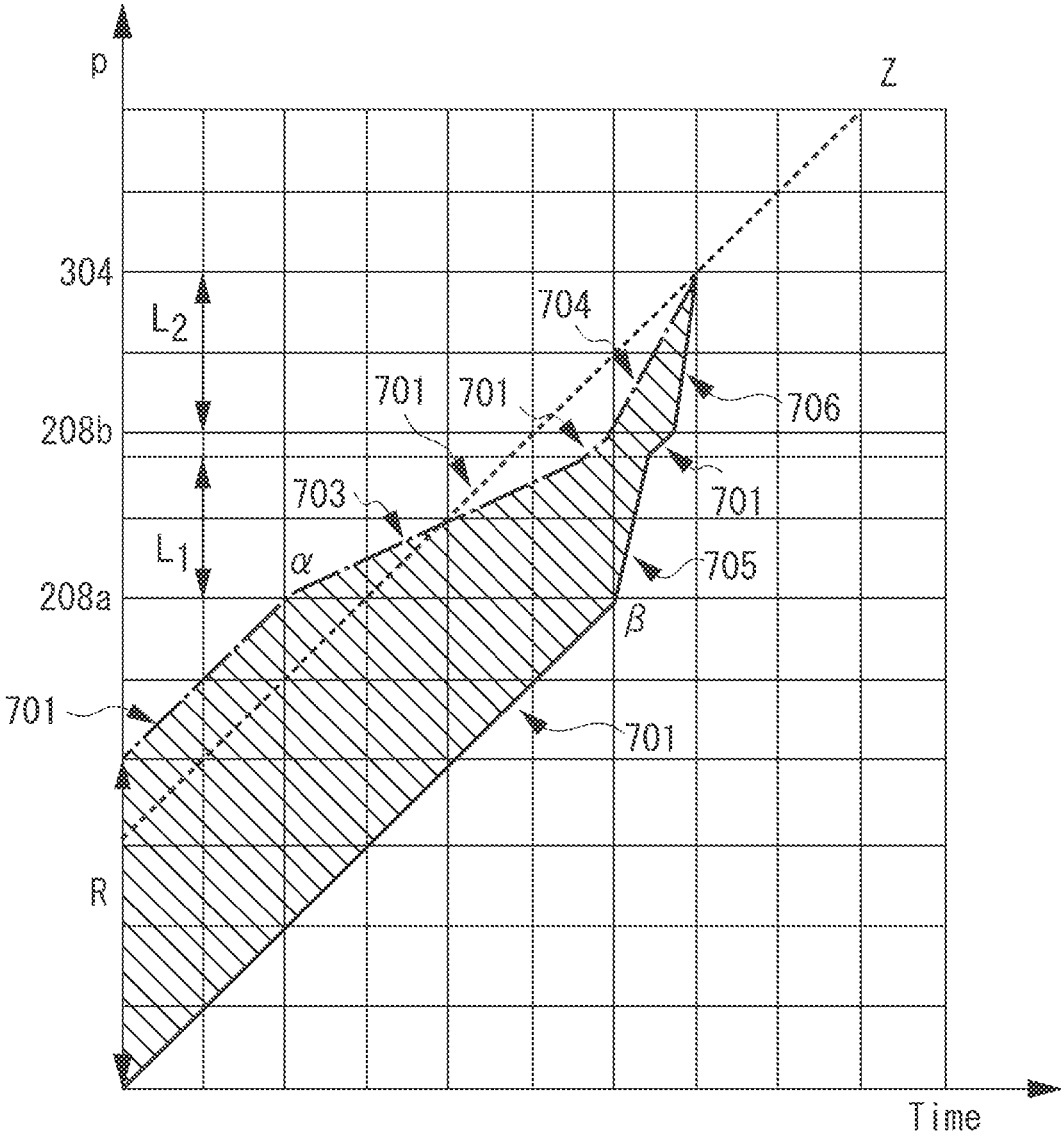
FIG. 4 is a chart illustrating the conveyance state of a sheet according to the first exemplary embodiment.
Figure 5:
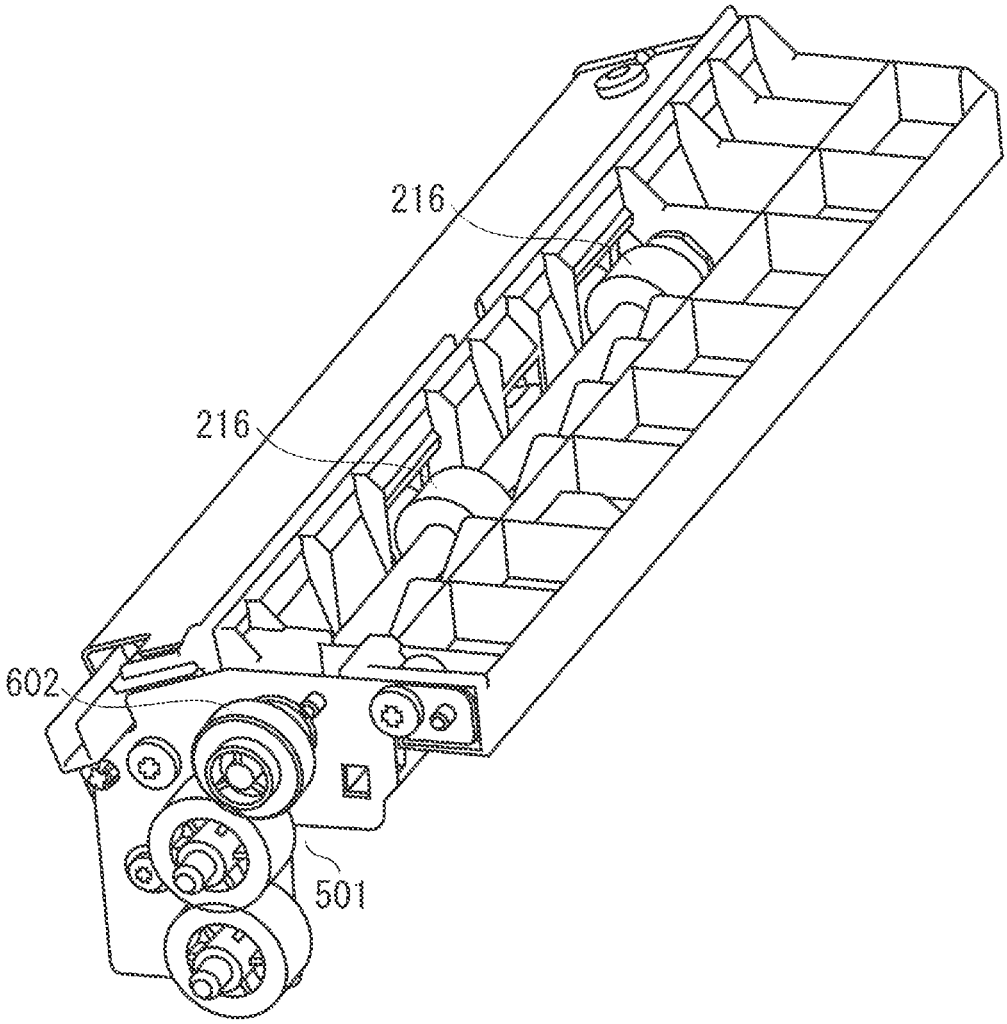
FIG. 5 is a schematic perspective view illustrating a configuration for transmitting a drive force to a conveyance roller according to the first exemplary embodiment.

FIG. 2 is a rear view of the image forming apparatus 100. FIG. 3 is a block diagram of the first exemplary embodiment. FIG. 4 is a timing chart of sheet conveyance speeds according to the first exemplary embodiment. FIG. 5 is a schematic perspective view illustrating a configuration for transmitting a drive force to a conveyance roller according to the first exemplary embodiment.

The image forming apparatus main body 1 is described below with reference to FIG. 1. The image forming apparatus main body 1 includes a sheet feeding unit 2 for feeding sheets one by one separated from a plurality of stacked sheets, an image forming unit 3 for forming an image on the fed sheet, and a sheet discharge unit 4 for discharging the sheets from the image forming unit 3.

The sheets stacked on a sheet stacking unit 201 provided on the sheet feeding unit 2 are fed by a feeding roller 202 and separated one by one by a feeding roller 203 and a retarding roller 204. A drive force is transmitted to the retarding roller 204 in the direction opposite to the direction in which the sheet is fed via a torque limiter. The retarding roller 204 separates and feeds sheets one by one when the plurality of sheets enters a nip between the feeding roller 203 and the retarding roller 204. The separated sheet is guided to a conveyance guide 205*a* and conveyed to a first conveyance unit 120. The first conveyance unit 120 includes a conveyance roller 206, which is rotatable with a transmitted drive force, and a driven roller 207, which is driven by a conveyance roller 206. The first conveyance unit 120 nips the sheet at a nip portion between the conveyance roller 206 and the driven roller 207 and conveys the sheet. The sheet conveyed by the first conveyance unit 120 is guided by conveyance guides 205*c* and 205*d* and an image is transferred to the sheet at a transfer unit 304. The transferred image is fixed to the sheet at a fixing unit 305. The sheet is discharged to the sheet discharge unit 4 by a discharge roller pair 401.

In the image forming unit 3, laser scanners 302*a* and 302*b* irradiate four charged photosensitive drums 301*y*, 301*m*, 301*c*, and 301*k* with light to develop an electrostatic latent image on the four charged photosensitive drums 301. Toner images developed on the four charged photosensitive drums 301 are transferred to the sheet conveyed from the sheet feeding unit 2 by a transfer belt 303 and a secondary transfer unit. The sheet to which the toner image is transferred is conveyed to the fixing unit 305 and subjected to heat and pressure to fix the toner image thereto. The sheet to which the toner image is fixed is discharged by the discharge roller pair 401 and stacked on a stack tray.

The feeding unit 5 which can be optionally attached to the image forming apparatus main body 1 is described below. The feeding unit 5 is attached upstream in the sheet conveyance direction to the image forming apparatus main body 1. Unlike anything that is originally mounted on the image forming apparatus main body 1 when the apparatus main body 1 is manufactured, the feeding unit 5 is the one that a user optionally adds to the image forming apparatus main body 1 being a finished product to add functions and enhance performances thereof. The feeding unit 5 is sold separately from the image forming apparatus main body 1 being the finished product, and used after a purchaser combining the feeding unit 5 with the image forming apparatus main body 1 being the finished product. Some of the feeding units 5 can store a large amount of sheets and sheets different in sizes.

The feeding unit 5 is arranged such that sheet feeding units 21, 22, and 23 for feeding the sheets to the image forming apparatus main body 1 are stacked one on top of another. Because the sheet feeding units 21, 22, and 23 are similar to one another in configuration, the topmost sheet feeding unit 21 is described. The sheet feeding unit 21 includes a feeding roller 212 for feeding the sheet stacked on a sheet stack unit 211, a feeding roller 213 for separating fed sheets one by one, and a retarding roller 214. The sheet feeding unit 21 is similar in configuration to the sheet feeding unit 2 provided in the image forming apparatus main body 1.

The sheet fed from the sheet feeding unit 21 is conveyed to a second conveyance unit 220, which is provided inside the feeding unit 5 for conveying the sheet to the image forming apparatus main body 1. The second conveyance unit 220 includes a conveyance roller 216 and a driven roller 217. The second conveyance unit 220 nips the sheet at a nip portion between the conveyance roller 216 and the driven roller 217 and conveys the sheet to the first conveyance unit 120 of the image forming apparatus main body 1. The distance between the first and second conveyance units 120 and 220 is set shorter than the length of the conveyed sheet in the conveyance direction. In other words, the distance between the first and second conveyance units 120 and 220 is set shorter than the length of the sheet whose size is minimum in the conveyance direction and on which the image forming apparatus main body 1 can form an image.

As illustrated in FIG. 2, a first drive motor 101 acting as a first drive unit is provided on the image forming apparatus main body 1. A second drive motor 501 acting as a second drive unit is provided on the feeding unit 5. The first drive motor 101 rotates the conveyance roller 206 of the first conveyance unit 120 and the second drive motor 501 rotates the conveyance roller 216 of the second conveyance unit 220.

As illustrated in FIG. 3, the drive of the first drive motor 101 is controlled by a first control unit 150. The drive of the second drive motor 501 is controlled by a second control unit 250.

A first detection unit 208*b* for detecting the sheet to be conveyed is provided in the vicinity of the nip portion between the conveyance roller 206 and the driven roller 207. The first detection unit 208*b* detects that the sheet passes the nip portion. The first control unit 150 determines the time when the sheet reaches the first conveyance unit 120 based on a result of detection by the first detection unit 208*b*, and controls the drive of the first drive motor 101 for driving the conveyance roller 206. More specifically, the first control unit 150 controls the first drive motor 101 to change the sheet conveyance speed of the first conveyance unit 120 so that the sheet conveyed by the conveyance roller 206 to the transfer unit 304 agrees with the image formed by the image forming unit 3. For example, if the sheet reaches the first detection unit 208*b* early, the first control unit 150 controls the first drive motor 101 to decelerate the sheet conveyance speed. On the other hand, if the sheet reaches the first detection unit 208*b* late, the first control unit 150 controls the first drive motor 101 to accelerate the sheet conveyance speed.

A second detection unit 208*a* for detecting the sheet to be conveyed is provided in the vicinity of the nip portion between the conveyance roller 216 and the driven roller 217. The second detection unit 208*a* detects that the sheet passes the nip portion between the conveyance roller 216 and the driven roller 217. The second control unit 250 determines the time when the sheet reaches the second conveyance unit 220 based on a result of detection by the second detection unit 208*a*, and controls the drive of the second drive motor 501 for driving the conveyance roller 216 to change the sheet conveyance speed of the second conveyance unit 220. For example, if the sheet reaches the second detection unit 208*a* early, the second control unit 250 controls the second drive motor 501 to decelerate the sheet conveyance speed. On the other hand, if the sheet reaches the second detection unit 208*a* late, the second control unit 250 controls the second drive motor 501 to accelerate the sheet conveyance speed.

The control of the first drive motor 101 by the first control unit 150 and the control of the second drive motor 501 by the second control unit 250 in a case where the sheet fed from the feeding unit 5 is conveyed are described below with reference to FIG. 4.

In a graph in FIG. 4, the abscissa indicates time (t) and the ordinate indicates a position (p) of the leading edge of the sheet on the downstream side in the conveyance direction. Therefore, tilt indicates the conveyance speed of the leading edge of the sheet. If the sheet conveyance speed does not disperse and the sheet is conveyed at a constant speed, a relation between the time and the position is given by a straight line indicated by a broken line Z.

Actually, however, the position of the leading edge of the sheet sometimes disperses due to an error of the sheet feeding operation. A range indicated by R is the maximum range within which the dispersion can be corrected by the acceleration and deceleration control of the drive motors 101 and 501 even if the position of the leading edge of the sheet disperses.

An alternate long and short dash line α indicates a case where the sheet reaches the uppermost conveyance roller 206 earliest within the range of the dispersion R. A solid line β indicates a case where the sheet reaches the uppermost conveyance roller 206 latest within the range of the dispersion R. In other words, the dispersion of the sheet conveyance speed can be corrected by the acceleration and the deceleration control of the drive motors 101 and 501 in the area shaded by slanting lines. The dispersion of the sheet conveyance speed cannot be corrected outside the area shaded by slanting lines, so that this is determined to be a paper jam.

The case where the sheet reaches the uppermost second detection unit 208*a* earliest, the case indicated by the alternate long and short dash line α, is described below. The second drive motor 501 rotates a roller pair inside the feeding unit 5 at a constant speed to convey the sheet to the uppermost second detection unit 208*a* at a speed 701.

When the second detection unit 208*a* detects the sheet, the second control unit 250 controls the second drive motor 501 to decelerate the sheet conveyance speed of the second conveyance unit 220 to a conveyance speed 703 in an area L1. The reason for the deceleration of the sheet conveyance speed of the second conveyance unit 220 is that the sheet reaches the second detection unit 208*a* early.

After that (when the sheet passes the area L1), the second control unit 250 controls the drive of the second drive motor 501 so that the sheet conveyance speed of the second conveyance unit 220 becomes equal to a speed 701 being a predetermined speed before the sheet reaches the first detection unit 208*b*. The first control unit 150 controls the first drive motor 101 so that the sheet conveyance speed of the first conveyance unit 120 becomes equal to the predetermined speed 701 before the sheet reaches the first conveyance unit 120. The sheet conveyance speed of the first conveyance unit 120 at this point has only to be the speed 701 or higher.

When the sheet conveyed by the second conveyance unit 220 at the speed 701 is detected by the first detection unit 208*b*, the first control unit 150 controls the drive of the first drive motor 101 to accelerate the sheet conveyance speed of the first conveyance unit 120 to a conveyance speed 704. The reason for the acceleration of the sheet conveyance speed of the first conveyance unit 120 is that the sheet reaches the first detection unit 208*b* later than the image formed by the image forming unit 3. Thereby, the sheet is conveyed at the speed 704 in an area L2 and reaches the transfer unit 304 at an appropriate timing, that is, the timing of when the sheet reaches the transfer unit 304 is made in agreement with a timing of the image formed by the image forming unit 3.

The case where the sheet reaches the uppermost second detection unit 208*a* latest, the case indicated by the solid line β, is described below. The second drive motor 501 rotates the roller pair inside the feeding unit 5 at the constant speed to convey the sheet to the uppermost second detection unit 208*a* at the speed 701.

When the second detection unit 208*a* detects the sheet, the second control unit 250 controls the second drive motor 501 to accelerate the sheet conveyance speed of the second conveyance unit 220 to a conveyance speed 705 in the area L1. The reason for the acceleration of the sheet conveyance speed of the second conveyance unit 220 is that the sheet reaches the second detection unit 208*a* late.

After that (when the sheet passes the area L1), the second control unit 250 controls the drive of the second drive motor 501 so that the sheet conveyance speed of the second conveyance unit 220 becomes equal to the speed 701 being the predetermined speed before the sheet reaches the first detection unit 208*b*. The first control unit 150 controls the first drive motor 101 so that the sheet conveyance speed of the first conveyance unit 120 becomes equal to the predetermined speed 701 before the sheet reaches the first conveyance unit 120. The speed of the first conveyance unit 120 at this point has only to be the predetermined speed 701 or higher.

When the sheet conveyed by the second conveyance unit 220 at the speed 701 is detected by the first detection unit 208*b*, the first control unit 150 controls the drive of the first drive motor 101 to accelerate the sheet conveyance speed of the first conveyance unit 120 to a conveyance speed 706. The reason for the acceleration of the sheet conveyance speed of the first conveyance unit 120 is that the sheet reaches the first detection unit 208*b* later than the image generated by the image forming unit 3. Thereby, the sheet is conveyed at the speed 706 in an area L2 and reaches the transfer unit 304 at an appropriate timing.

As described above, in the first exemplary embodiment, even if the sheet conveyance speed disperses due to an error, the first control unit 150 and the second control unit 250 can independently control the first drive motor 101 and the second drive motor 501, respectively, so that the sheet can be stably conveyed.

More specifically, the second control unit 250 controls the second drive motor 501 so that the timing of when the sheet reaches the first detection unit 208*b* is made later than the timing of the image generated by the image forming unit 3. If both of the second conveyance unit 220 and the first conveyance unit 120 convey the same sheet, the sheet conveyance speed of the second conveyance unit 220 is made lower than that of the first conveyance unit 120.

Thereby, the sheet is not bent between the second conveyance unit 220 and the first conveyance unit 120 to reduce a load on the second drive motor 501 for driving the second conveyance unit 220. Therefore, there is no need for increasing a torque required for the second drive motor 501, thereby preventing an increase in the size and cost of the apparatus.

According to the first exemplary embodiment, each of the control units provided on the image forming apparatus main body 1 and the feeding unit 5 can control the conveyance speeds independently without communicating their conveyance speeds to one another, so that there is no need for increasing the size of the control units, that is, there is no need for complicating the control units.

Even if an apparatus other than the feeding unit 5 is attached to the image forming apparatus main body 1 as an option, the similar effect can be achieved by applying the present exemplary embodiment to a combination of the option and the image forming apparatus main body 1. Alternatively, even if the feeding unit 5 is attached to another different main body other than the image forming apparatus main body 1, the similar effect can be achieved. According to the first exemplary embodiment, the image forming apparatus main body as the first unit and the option as the second unit attachable to the main body can be combined in various forms without increasing the size of the control units provided thereon.

As illustrated in FIG. 5, a one-way gear 602 acting as a one-way unit freely rotating in one direction is provided between the second drive motor 501 and the conveyance roller 216. The one-way gear 602 is provided to rotatably drive the conveyance roller 216, decreasing a load on the first drive motor 101 even if the sheet conveyance speed of the second conveyance unit 220 is made lower than that of the first conveyance unit 120.

According to the exemplary embodiment of the present invention, the sheet is conveyed so that the sheet conveyance speed of the first conveyance unit becomes equal to or higher than that of the second conveyance unit. Consequently, according to the exemplary embodiment of the present invention, the sheet can be conveyed without causing a load on the drive unit due to a bend of the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-278520 filed Dec. 20, 2012, which is hereby incorporated by reference herein in its entirety.

What is claimed is:

1. A sheet conveyance apparatus comprising a first unit and a second unit attachable to the first unit, the first unit including:

a first conveyance unit configured to convey a sheet;

a first drive unit configured to drive the first conveyance unit;

a first detection unit provided in the vicinity of the first conveyance unit and configured to detect the sheet; and a first control unit configured to control the drive of the first drive unit so that a sheet conveyance speed of the first conveyance unit changes based on a result of detection by the first detection unit; and the second unit including:

a second conveyance unit provided upstream of the first conveyance unit and configured to convey the sheet;

a second drive unit configured to drive the second conveyance unit;

a second detection unit provided in the vicinity of the second conveyance unit and configured to detect the sheet; and a second control unit configured to control the drive of the second drive unit so that a sheet conveyance speed of the second conveyance unit changes based on a result of detection by the second detection unit; and a one-way unit provided between the second drive unit and the second conveyance unit, wherein, when the sheet is conveyed by the second and first conveyance units, the first control unit controls the first drive unit and the second control unit controls the second drive unit so that a sheet conveyance speed of the first conveyance unit becomes equal to or higher than that of the second conveyance unit, wherein the one-way unit is configured to rotatably drive the second conveyance unit even if the sheet conveyance speed of the second conveyance unit is made lower than that of the first conveyance unit such that the sheet can be conveyed without causing a load on the first drive unit due to a bend of the sheet.

2. The sheet conveyance apparatus according to claim 1, wherein the second control unit changes the sheet conveyance speed of the second conveyance unit to a predetermined speed before the sheet conveyed by the second conveyance unit reaches the first detection unit, and wherein the first control unit makes the sheet conveyance speed of the first conveyance unit equal to or higher than the predetermined speed before the sheet conveyed by the second conveyance unit at the predetermined speed reaches the first conveyance unit.

3. The sheet conveyance apparatus according to claim 1, wherein, when the sheet is conveyed by the second and first conveyance units, the first control unit controls the first drive unit and the second control unit controls the second drive unit so that the sheet conveyance speed of the first conveyance unit becomes higher than that of the second conveyance unit.

4. The sheet conveyance apparatus according to claim 1, wherein the first unit is an image forming apparatus main body including a sheet feeding unit for feeding sheets and an image forming unit for forming an image on the sheet fed from the sheet feeding unit, and wherein the second unit is a feeding unit attachable to the image forming apparatus main body.

5. The sheet conveyance apparatus according to claim 4, wherein the first control unit controls the drive of the first drive unit so that the sheet conveyed by the first conveyance unit agrees with the timing of the image formed by the image forming unit.

6. A sheet conveyance apparatus comprising:

a first conveyance unit configured to convey a sheet;

a first drive unit configured to drive the first conveyance unit;

a first detection unit configured to detect the sheet;

a second conveyance unit provided upstream of the first conveyance unit and configured to convey the sheet;

a second drive unit configured to drive the second conveyance unit;

a second detection unit configured to detect the sheet; and a control unit configured to control the drive of the first drive unit so that a sheet conveyance speed of the first conveyance unit changes based on a result of detection by the first detection unit; and to control the drive of the second drive unit so that a sheet conveyance speed of the second conveyance unit changes based on a result of detection by the second detection unit; and wherein, in a case where the second detection unit detects that a sheet is conveyed behind a predetermined timing, the control unit controls the second drive unit so that a sheet conveyance speed of the second conveyance unit to become a first speed by accelerating the sheet conveyance speed before a front edge of a sheet conveyed by the second conveyance unit reaches the first conveyance unit, wherein the control unit controls the second drive unit so that a sheet conveyance speed of the second conveyance unit to decelerated from the first speed to a second speed that is slower than the first speed before a front edge of a sheet conveyed by the second conveyance unit reaches the first conveyance unit, and wherein, after a front edge of a sheet conveyed by the second conveyance unit reaches the first conveyance unit, a sheet conveyance speed of the first conveyance unit is in a third speed that is faster than the second speed.

7. The sheet conveyance apparatus according to claim 6, wherein, a sheet conveyance speed before being detected by the second detection unit is a speed that is slower than the first speed.

8. The sheet conveyance apparatus according to claim 6, wherein, in a case where the second detection unit detects that a sheet is conveyed before a predetermined timing, the control unit controls the second drive unit so that a sheet conveyance speed of the second conveyance unit to decelerated to a fourth speed.

9. The sheet conveyance apparatus according to claim 8, wherein, before a front edge of a sheet conveyed by the second conveyance unit reaches the first conveyance unit, the control unit controls the second drive unit so that a sheet conveyance speed of the second conveyance unit to accelerate from the fourth speed to the second speed that is faster than the fourth speed.

10. The sheet conveyance apparatus according to claim 6, wherein, in response to the first detection unit detecting a sheet conveyed by the second conveyance unit in the second speed, the control unit controls the first drive unit so that a sheet conveyance speed of the first conveyance unit to become the third speed.

11. The sheet conveyance apparatus according to claim 6, wherein a sheet conveyance speed before being detected by the second detection unit is the second speed.

12. A sheet conveyance apparatus comprising:

a first conveyance unit configured to convey a sheet;

a first drive unit configured to drive the first conveyance unit;

a first detection unit configured to detect the sheet; and a second conveyance unit provided upstream of the first conveyance unit and configured to convey the sheet;

a second drive unit configured to drive the second conveyance unit;

a second detection unit configured to detect the sheet; and a control unit configured to control the drive of the first drive unit so that a sheet conveyance speed of the first conveyance unit changes based on a result of detection by the first detection unit and to control the drive of the second drive unit so that a sheet conveyance speed of the second conveyance unit changes based on a result of detection by the second detection unit; and wherein, in a case where the second detection unit detects that a sheet is conveyed before a predetermined timing, the control unit controls the second drive unit so that a sheet conveyance speed of the second conveyance unit to become a first conveyance speed by deccelerating the sheet conveyance speed before a front edge of a sheet conveyed by the second conveyance unit reaches the first conveyance unit, wherein, the control unit controls the second drive unit so that a sheet conveyance speed of the second conveyance unit to become a second conveyance speed that is faster than the first conveyance speed before a front edge of a sheet conveyed by the second conveyance unit reaches the first conveyance unit by accelerating the sheet conveyance speed from the first conveyance speed, and wherein, after a front edge of a sheet conveyed by the second conveyance unit reaches the first conveyance unit, a sheet conveyance speed of the first conveyance unit is in a third conveyance speed that is faster than the second conveyance speed.

13. The sheet conveyance apparatus according to claim 12, wherein the first drive unit, the first conveyance unit and the first detection unit are provided on an image forming apparatus configured to form an image on a sheet, wherein the second drive unit, the second conveyance unit and the second detection unit are provided on a feeding unit feeding unit which is loaded on the image forming apparatus, wherein the image forming apparatus is arranged at downstream side of the first conveyance unit and includes an image forming unit configured to form an image on a sheet conveyed by the first conveyance unit, and wherein the control unit controls the drive of the first drive unit so that the sheet conveyed by the first conveyance unit agrees with the timing of the image formed by the image forming unit.

14. The sheet conveyance apparatus according to claim 13, wherein the feeding unit is loaded on the image forming apparatus as an option.

15. The sheet conveyance apparatus according to claim 14, wherein the control unit includes a first control unit configured to control the first driving unit and a second control unit configured to control the second driving unit, and wherein the first control unit is provided to an image forming apparatus, and wherein the second control unit is provided to the feeding unit.

16. The sheet conveyance apparatus according to claim 15, wherein the first control unit controls a sheet conveyance speed of the first conveyance unit by controlling the first driving unit without communicating with the second control unit regarding information of a sheet conveyance speed of the second conveyance unit.

17. The sheet conveyance apparatus according to claim 12, wherein the first detection unit is provided in the vicinity of the first conveyance unit and the second detection unit is provided in the vicinity of the second conveyance unit.

18. The sheet conveyance apparatus according to claim 12, wherein the first conveyance unit includes a first driving roller and a first driven roller, wherein the second conveyance unit includes a second driving roller and a second driven roller, and wherein the control unit changes a rotating speed of the first driving roller by controlling the first drive unit and changes a rotating speed of the second driving roller by controlling the second drive unit.

19. The sheet conveyance apparatus according to claim 18, wherein the first driving unit includes a first motor, wherein the second drive unit includes a second motor, and wherein the control unit changes a rotating speed of the first motor and a rotating speed of the second motor.

20. The sheet conveyance apparatus according to claim 12, further comprising:

an one-way member provided between the second drive unit and the second conveyance unit, wherein, while the second conveyance unit rotates by being driven by a sheet which is conveyed by the first conveyance unit, the one-way member prevents a load from being added on the first driving unit.

21. The sheet conveyance apparatus according to claim 12, wherein a distance between the first conveyance unit and the second conveyance unit is shorter than a length of a conveyed sheet in a conveyance direction.

22. The sheet conveyance apparatus according to claim 12, wherein, a sheet conveyance speed before being detected by the second detection unit is the second conveyance speed.

23. The sheet conveyance apparatus according to claim 12, wherein, a sheet conveyance speed of the first conveyance unit before being detected by the first detection unit is the second conveyance speed.

24. The sheet conveyance apparatus according to claim 23, wherein, wherein, in response to the first detection unit detecting a sheet, the control unit controls the first drive unit so that a sheet conveyance speed of the first conveyance unit to become the third conveyance speed.

* * * * *